United States Patent [19]

Guglielmo

[11] Patent Number: 5,059,050

[45] Date of Patent: Oct. 22, 1991

[54] DISPENSER FOR HAIR TREATMENT SOLUTIONS

[76] Inventor: Michael E. Guglielmo, 28 Cressida Dr., Old Bridge, N.J. 08857

[21] Appl. No.: 560,817

[22] Filed: Jul. 31, 1990

Related U.S. Application Data

[63] Continuation of Ser. No. 192,149, May 10, 1988, abandoned.

[51] Int. Cl.[5] ..... B05C 17/01; B05C 17/015; B43K 5/06; A45D 24/22

[52] U.S. Cl. ..... 401/171; 401/28; 401/207; 132/112; 132/116

[58] Field of Search ..... 401/11, 12, 25, 26, 401/28, 140, 171, 176, 181, 207; 132/112, 116, 148, 150–152, 331, 332, 113

[56] References Cited

U.S. PATENT DOCUMENTS

| | | | |
|---|---|---|---|
| 1,382,586 | 6/1921 | Wilson | 132/112 X |
| 1,429,635 | 9/1922 | Ross | 132/114 X |
| 1,607,674 | 11/1926 | Ives | 132/114 |
| 2,232,218 | 2/1941 | Doty | 132/112 X |
| 2,556,609 | 6/1951 | Arkless | 401/181 X |
| 2,756,498 | 7/1956 | Wasser | 401/12 X |
| 2,922,425 | 1/1960 | Lerner et al. | 401/28 X |
| 3,960,160 | 6/1976 | Hogan | 132/112 |
| 3,961,635 | 6/1976 | Miya | 132/113 |
| 4,462,413 | 7/1984 | Schmitz | 132/113 |
| 4,495,958 | 1/1985 | Roeder | 132/113 |
| 4,516,591 | 5/1985 | Hierholzer | 132/116 X |
| 4,566,472 | 1/1986 | Mueller et al. | 132/112 |

FOREIGN PATENT DOCUMENTS

| | | | |
|---|---|---|---|
| 433889 | 1/1912 | France | 132/114 |
| 2307490 | 12/1976 | France | 132/112 |
| 309725 | 9/1955 | Sweden | 132/114 |

*Primary Examiner*—Richard J. Apley
*Assistant Examiner*—D. F. Crosby
*Attorney, Agent, or Firm*—Peter L. Klempay

[57] ABSTRACT

A dispenser for applying a treatment solution to selected strands of hair includes a reservoir and a dispensing nozzle. The nozzle is an elongate, preferably conical member, having one or more slots extending from and dividing the tip into tines. The side walls of the slot converge inwardly from one side of the nozzle, a through bore extends from the base of the slot to the base of the nozzle, and at least one of the tines is shorter than the other. The reservoir may be a squeezable bottle or, in the preferred embodiment, an open top container having a handle projecting from one side with a lever arm pivotally connected to the outer end of the arm and mounting a plate-like piston slidably received in the container.

17 Claims, 3 Drawing Sheets

DISPENSER FOR HAIR TREATMENT SOLUTIONS

This application is a continuation of my prior application Ser. No. 07/192,149, filed on May 10, 1988, entitled: DISPENSER FOR HAIR TREATMENT SOLUTIONS, now abandoned.

The present invention pertains to a dispenser for applying a treatment solution to the hair and, more particularly, to such a device for applying treatment solution to selected portions of the hair.

BACKGROUND OF THE INVENTION

A technique frequently employed in hair styling is that of highlighting, the application of a treatment solution such as a dye or a bleach to selected strands of the hair to give these strands an appearance differing from that of the remaining hair. A common procedure for accomplishing this technique involves the use of a rubber cap with holes, the cap being placed over the hair and strands of hair being drawn through the holes and coated with the treatment solution. This procedure, while effective, is both time-consuming and uncomfortable.

Dispensers for applying highlighting and similar treatment solutions to selected portions of the hair without the use of a rubber cap have been proposed. Examples of such dispensers are found in U.S. Pat. Nos. 4,516,591, Hierholzer, and 4,605,026, Nolin. Each of these devices includes a comb-like head and a base which attachs to a container such as a squeezable bottle or tube containing the treatment solution and has conduits extending through the base and head for dispensing the treatment solution in the vicinity of certain of the comb teeth. These devices are intended to apply the treatment solution simultaneously to multiple groups of hair strands at uniformly spaced intervals which limits the effects which may be achieved with their use. The length and number of conduits within these devices can render cleaning of the devices difficult with the result that some of the dispensing conduits become clogged, reducing the effectiveness of the tool.

It is a principal object of the present invention to provide a dispenser for applying hair treatment solutions to selected strands of the hair.

It is also an object of the present invention to provide such a dispenser the dispensing head of which is configured to facilitate separation of the hair strands to be treated from the remaining hair.

Another object of the present invention is the provision of such a dispenser which effects a thorough coating of the hair within the selected strands.

A further object of the present invention is the provision of such a dispenser which may be easily and thoroughly cleaned.

SUMMARY OF THE INVENTION

The above and other objects of the present invention which will become apparent hereinafter are achieved by the provision of a hair treatment solution dispenser having a reservoir for the solution and a dispensing nozzle removably connected to the reservoir. The dispensing nozzle is an elongate, generally conical member having a base configured for attachment to the reservoir; a through passage extending axially from the base, and a tip portion which, in a first embodiment, has two tines separated by a diametric slot extending from the end thereof to intersect the through passage, the slot being of greater width on one side of the tip than the other and one of the tines being shorter than the other with the end thereof sloping toward the slot. An alternate embodiment of the nozzle has two parallel slots forming three tines, the slots again narrowing from one side to the other, the center tine being of lesser length than the outer two, the ends of the tines sloping toward the adjacent slots. The reservoir may be a squeezable container or, in the preferred embodiment of the invention, consists of an open top, parallel sided container having an opening in the bottom wall at which the nozzle is attached; a handle extending laterally from one side of the container; a lever pivotally connected at one of its ends to the end of the handle, the lever arm extending in overlying relation to the handle; and a plate-like piston pivotally attached to the free end of the lever arm and slidably received within the container.

For a more complete understanding of the invention and the objects and advantages thereof, reference should be had to the accompanying drawings and the following detailed description wherein preferred embodiments of the invention are illustrated and described.

DESCRIPTION OF THE PREFERRED EMBODIMENTS

Figure 1:
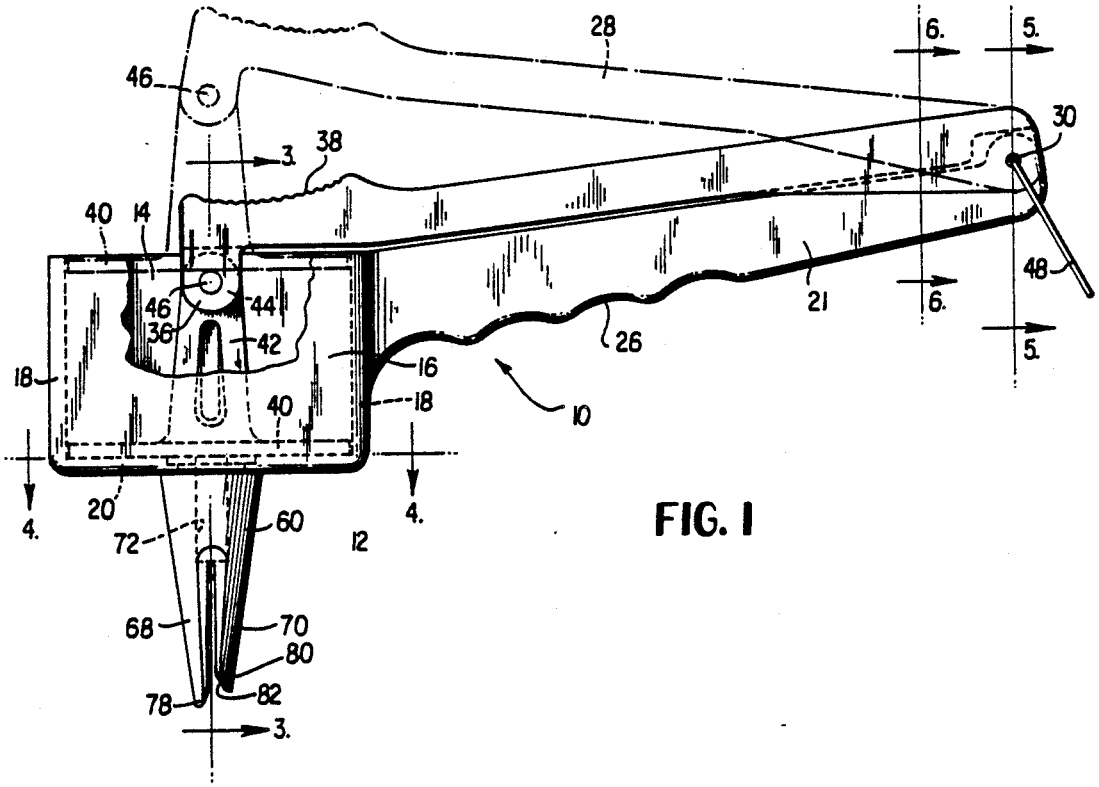
FIG. 1 is a side elevational view of a first embodiment of the dispenser of the present invention.
Figure 2:
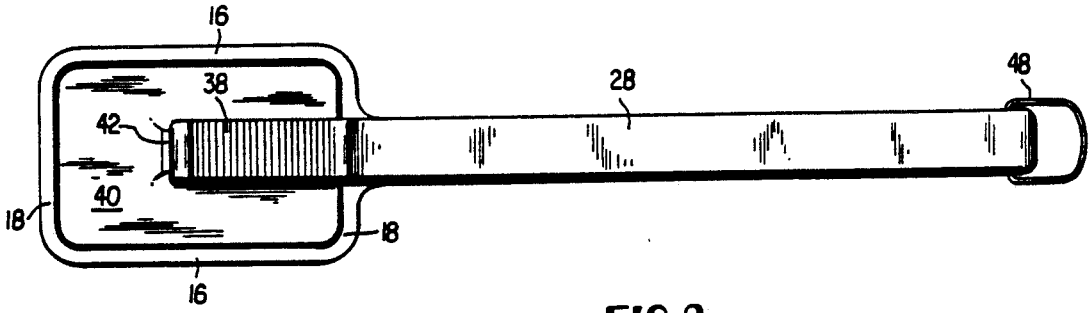
FIG. 2 is a top plan view thereof.
Figure 3:
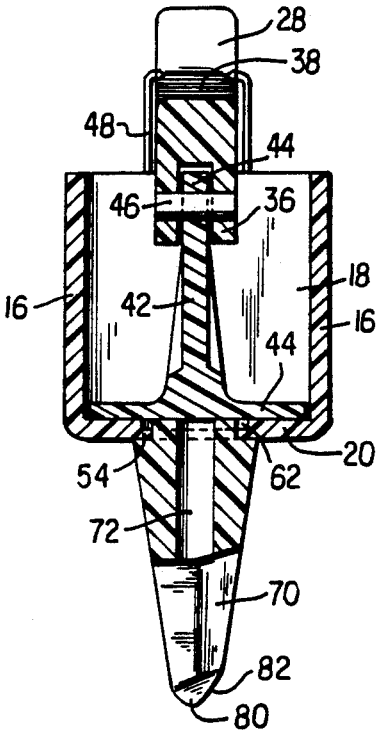
FIGS. 3, 4, 5 and 6 are cross sectional views taken on the lines 3—3, 4—4, 5—5 and 6—6, respectively, of FIG. 1.
Figure 4:
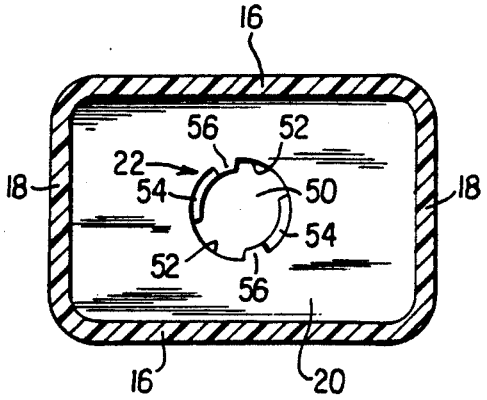
Figure 5:
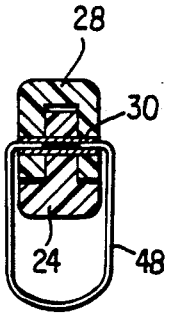
Figure 6:
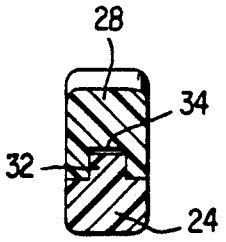

The embodiment of the invention shown in FIGS. 1–6 includes a reservoir and dispensing mechanism, designated generally by the reference numeral 10, and a dispensing nozzle, designated generally by the reference numeral 12, each of which, preferrably, is formed of injection molded plastic material. The mechanism 10 has an open-top reservoir 14 with straight, parallel side walls 16 and end walls 18 and a bottom wall 20. A central opening 22 is provided in the bottom wall to receive the nozzle 12. Projecting laterally and upwardly at a slight angle from one of the end walls 18 on the longitudinal centerline of the reservoir is an elongated handle 24 having, on the lower surface thereof, a series of concave finger rests 26. A lever arm 28 overlies the handle and is pivottally connected thereto by a pin 30 located adjacent the extremity of the handle. As is shown in FIG. 6, the upper face of handle 24 is provided, forwardly of the pivotal connection 30, with a centrally located, upwardly projecting ridge 32 and the lower face of the arm 28 with a complementary recess 34, the arrangement serving to maintain alignment of the arm with the handle. Lever arm 28 projects forwardly over the reservoir 14, terminating with a pair of downwardly projecting lugs 36, the upper surface of the arm adjacent this end being provided with a thumb rest 38, preferrably in the form of a shallow, concave serrated surface. A flat plate piston 40 has an upwardly projecting trunnion 42 terminating in a lug 44 which is received between the lugs 36 of the lever arm and pivotally connected thereto by a pin 46. The piston 40 is sized so as to have a close sliding fit within the side and end walls 16, 18 of the reservoir 14. As mentioned above, the handle 24 is angled upwardly. The upward inclination of the handle is such that the axis of the pivotal connection 30 is spaced above the plane of the top surface of the reservoir 14 by a distance which is equal to one half the distance between the axis of the pin 46 and the lower face of the piston 40, the arrangement permitting the piston 40 to be oriented parallel to the top of the reservoir upon entry therein, as is shown in phantom outline in FIG. 1.

Preferrably, the pin 30 forming the pivotal connection of the handle 24 and lever arm 28 is hollow for reception of the ends of a metal ring or loop 48. The ring provides a means for hanging the dispenser when not is use.

The central opening 22 of the reservoir bottom wall 20 includes a circular center section 50 having diametrically located arcuate extensions 52 separated by arcuate flanges 54 which are of reduced thickness relative to the wall 20 and which are provided at one end thereof with lugs 56 of the same thickness as the wall 20. As will be discussed below, the arrangement provides a bayonet type connection for the nozzle 12.

Figure 7:
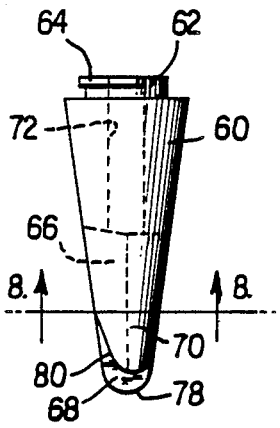
FIG. 7 is a side elevational view of the dispensing nozzle detached from the dispenser of FIG. 1.
Figure 8:
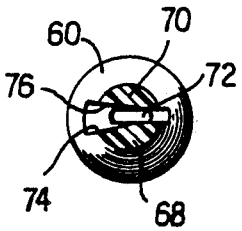
FIG. 8 is a transverse cross sectional view taken on the line 8—8 of FIG. 7.
Figure 9:
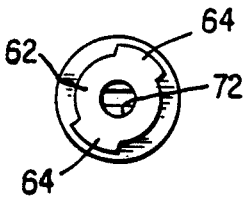
FIG. 9 is a top plan view of the nozzle of FIG. 7.

Dispensing head or nozzle 12 includes a tapered, preferrably conical, body portion 60 having a cylindrical hub 62 projecting from the base thereof, the hub having a pair of diametrically opposed arcuate flanges 64 for engagement in the bayonet socket in the reservoir bottom wall. A diametric slot 66 extends approximately one half the length of the body portion 60 from the tip thereof, forming a pair of tines 68, 70. A through bore 72 extends axially from the base of slot 66 through hub 62 to provide fluid communication with the reservoir 14. As can be seen from FIG. 8, the side walls 74, 76 of the slot converge inwardly from one side of the nozzle, referred to hereinafter as the front side. The portion of the base or root of the slot to the front side of the bore is angled, as shown in FIG. 7, the edges thereof being rounded to provide a smooth transition to the side walls. The first tine 68 terminates in a smoothly rounded tip 78. The second tine 70 is shorter than the first and terminates in a rounded tip 80 the inner face 82 of which beveled toward the slot wall 76 and front side of the nozzle.

Figure 10:
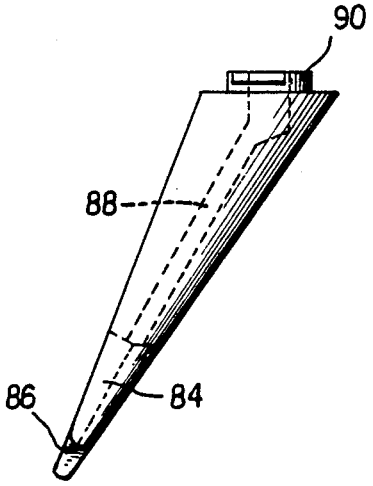
FIG. 10 is a side elevational view of a first modification of the dispensing nozzle.

A modified form of the dispensing head or nozzle is shown in FIG. 10. This embodiment includes a body portion 84 having a diametric slot 86 and through bore 88 of substantially the same configuration as the nozzle described above. The base and hub 90 of the modified nozzle, however, are angled relative to the axis of the body portion.

Figure 11:
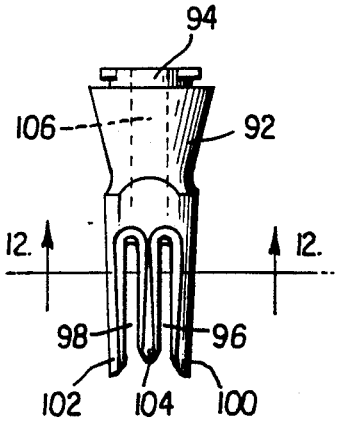
FIG. 11 is a front elevational view of a second modification of the dispensing nozzle.
Figure 12:
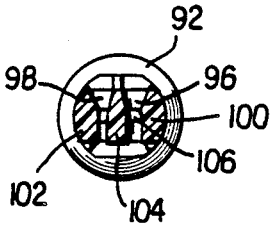
FIG. 12 is a transverse cross sectional view taken on the line 12—12 of FIG. 11.

FIGS. 11 and 12 illustrate a further modification of the nozzle. The body portion 92 of this embodiment is provided with a boss 94 for connection to the reservoir with two parallel slots 96 and 98 dividing the outer end of the body portion into three tines, the outer two 100 and 102 of which are of greater length than the central tine 104. As with the first described embodiment of the nozzle, the side walls of the slots converge inwardly from the front side of the nozzle and the ends of the tines are beveled. A bore 106 entends through the body portion to intersect the bases of the two slots.

In use of the treatment solution dispenser of the present invention, one of the dispensing heads or nozzles is selected and attached to the reservoir. As discussed above, the nozzles have front and back sides, the bayonet type connection permitting the nozzle to be installed for either left or right hand use, as desired, and assuring proper orientation of the nozzle. With the piston 40 withdrawn from the reservoir 14 by upward movement of the lever arm 28, the reservoir is filled with the treatment solution after which the piston is moved downwardly sufficiently to close the top of the reservoir. Holding the dispenser in the hand with the thumb on the rest 38, the device is moved along the head with the nozzle combing a group or groups of hair strands, the longer of the tines serving to initially separate the selected strands from the remaining hair, the beveled ends of the tips further aiding in this separation. With the application of thumb pressure, treatment solution is forced into the base of the nozzle slot and into contact with the selected strands. The converging walls of the slot serve to compress the coated group of hair strands thus forcing the treatment solution into intimate contact with all the hair strands. As there are no lengthy or closed end passageways, the dispenser is easily and thoroughly cleaned after use.

Figure 13:
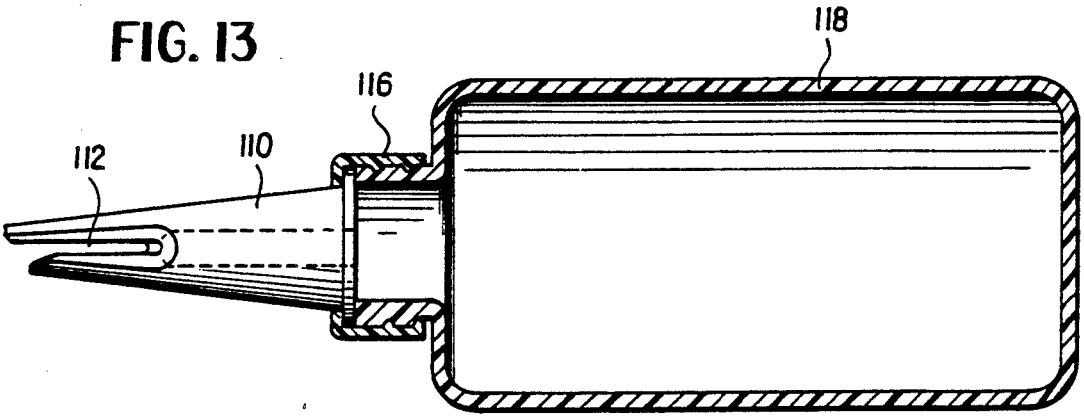
FIG. 13 is a transverse cross sectional view of a second embodiment of the dispenser of the present invention.

It will be apparent that the dispensing head or nozzle configurations of the present invention may also be used with dispensing devices other than that described above. One such alternate dispenser arrangement is shown in FIG. 13. The nozzle 110, as with the previously described embodiments, has one or more slots 112 extending from the tip thereof and a through bore 114. At the base of the nozzle there is provided a threaded cap 116 for connection to the mouth of a squeezable bottle 118.

While preferred embodiments of the invention have been described and illustrated in detail herein, it will be understood that changes and additions may be had therein and thereto without departing from the spirit of the invention. Reference should, accordingly, be made to the appended claims in determining the true scope of the invention.

I claim:

1. A device for applying treatment solution to strands of hair comprising:

an open top reservoir for holding a supply of treatment solution, said reservoir having straight side walls, the upper ends of which terminate in a common plane, and a bottom wall joining the lower ends of said walls, an opening being provided in said bottom wall;

a handle projecting laterally from one side of said side walls of said reservoir adjacent said upper end thereof, said handle being angled relative to said side wall whereby the free end of said handle is located above the common plane, said handle having a series of concave finger rests on the lower surface thereof;

a pin carried by said handle adjacent the free end thereof;

a lever arm pivotally connected at one end to said handle at the free end thereof by means of said pin, the opposite end of said lever arm being located above said reservoir, said lever arm having a thumb rest on the upper surface thereof adjacent said opposite end;

a flat piston connected to said opposite end of said lever arm and slidably receivable in said reservoir; and a dispensing nozzle detachably connected to the bottom wall of said reservoir, said nozzle having at least two tines defining therebetween a slot for reception of a group of hair strands and a through bore extending from the base of said slot communicating with said opening in said reservoir.

2. The treatment solution applying device of claim 1 wherein said piston is connected to said lever arm by a trunnion projecting upwardly from said piston and having its upper end pivotally connected to said lever arm.

3. The treatment solution applying device of claim 2 wherein the pivotal connection between said handle and said lever arm is spaced above the common plane in a vertical direction a distance equal to substantially one-half the length of said trunion.

4. The treatment solution applying device of claim 1 wherein said dispensing nozzle has a front side through which hair enters the slots between the tines and wherein the connection between said dispensing nozzle and said reservoir is configured to orient said dispensing nozzle in one of two oppositely oriented positions for either left or right hand use.

5. The treatment solution applying device of claim 4 wherein said connection is a bayonet type connection.

6. A device for applying treatment solution to strands of hair comprising:

a reservoir for holding a supply of treatment solution; and a dispensing nozzle, said nozzle being an elongate member having a base at one end and a tip portion extending to an opposite free end, said base being adapted for connection to said reservoir and having a through bore for receiving treatment solution from said reservoir, said tip portion including at least one slot extending from said free end toward said base to form at least two tines and communicating with said bore, said slot having entry and exit portions and narrowing uniformily from said entry portion to the midpoint thereof and being of uniform width from the midpoint to said exit portion for reception of a group of strands of hair.

7. The device for applying treatment solution of claim 6 wherein one of said tines is of lesser length than the other.

8. The device for applying treatment solution of claim 7 wherein the end of said one of said tines bevels inwardly toward said slot.

9. The device for applying treatment solution of claim 8 wherein said nozzle has two tines.

10. The device for applying treatment solution of claim 8 wherein said nozzle has three tines, said one of said tines being the middle one.

11. The device for applying treatment solution of claim 6 wherein said base is configured to connect said nozzle to said reservoir in either of two oppositely oriented positions only.

12. A dispensing nozzle for applying treatment solution from a supply container to strands of hair comprising:

a tapered body portion;

a hub extending from the larger end of said body portion configured for connection to the supply container, said body portion and said hub being provided with a through bore extending axially therethrough; and first and second tines extending from the smaller end of said body portion and separated by a slot the base of which communicates with said through bore, said slot having entry and exit portions and converging uniformly inwardly from said entry portion to the axial centerline of said slot and being of uniform width from said centerline to said exit portion, and said first tine being shorter than said second tine.

13. The dispensing nozzle of claim 12 wherein the end portion of said first tine is beveled inwardly toward said slot.

14. The dispensing nozzle of claim 13 further including a third tine of the same length as said second tine located on the opposite side of said first tine and defining, with said first tine, a second slot also communicating with said bore and of the same configuration as the firstmentioned slot.

15. The dispensing nozzle of claim 12 further including a third tine of the same length as said second tine located on the opposite side of said first tine and defining, with said first tine, a second slot also communicating with said bore and of the same configuration as the firstmentioned slot.

16. The dispensing nozzle of claim 12 wherein said hub includes a threaded cap for connecting said nozzle to the mouth of a bottle constituting the supply container.

17. The dispensing nozzle of claim 12 wherein said hub is configured to connect said nozzle to the supply container in either of two oppositely oriented positions.

* * * * *